US009972481B2

(12) United States Patent
Zhu et al.

(10) Patent No.: US 9,972,481 B2
(45) Date of Patent: May 15, 2018

(54) IONIZATION SOURCE FOR ELECTROSPRAY IONIZATION MASS SPECTROMETRY AND MS ANALYSIS

(71) Applicant: ZHEJIANG HAOCHUANG BIOTECH CO., LTD., Zhejiang (CN)

(72) Inventors: Yixin Zhu, Zhejiang (CN); Tingting Lu, Zhejiang (CN)

(73) Assignee: ZHEJIANG HAOCHUANG BIOTECH CO. LTD., Zhejiang (CN)

( * ) Notice: Subject to any disclaimer, the term of this patent is extended or adjusted under 35 U.S.C. 154(b) by 0 days. days.

(21) Appl. No.: 15/331,321

(22) Filed: Oct. 21, 2016

(65) Prior Publication Data

US 2017/0117128 A1 Apr. 27, 2017

(30) Foreign Application Priority Data

Oct. 23, 2015 (CN) ..... 2015 1 0700128

(51) Int. Cl.

| | |
|---|---|
| ***H01J 49/16*** | (2006.01) |
| ***H01J 49/00*** | (2006.01) |
| ***H01J 49/02*** | (2006.01) |
| ***H01J 49/04*** | (2006.01) |
| ***H01J 49/24*** | (2006.01) |

(52) U.S. Cl.

CPC ..... *H01J 49/165* (2013.01); *H01J 49/0031* (2013.01); *H01J 49/022* (2013.01); *H01J 49/0468* (2013.01); *H01J 49/24* (2013.01)

(58) Field of Classification Search

CPC ..... H01J 49/0027; H01J 49/0031; H01J 49/0468; H01J 49/165; H01J 49/167; H01J 49/168; H01J 49/24; H01J 49/26; G01N 27/622

See application file for complete search history.

(56) References Cited

U.S. PATENT DOCUMENTS

| | | | | |
|---|---|---|---|---|
| 4,999,493 A * | 3/1991 | Allen | G01N 30/7266 | 250/282 |
| 5,070,240 A * | 12/1991 | Lee | H01J 49/401 | 250/286 |
| 6,870,154 B1 * | 3/2005 | Konermann | H01J 49/0431 | 250/281 |
| 7,335,877 B1 * | 2/2008 | Han | H01J 49/165 | 250/281 |
| 2005/0072934 A1 * | 4/2005 | Frazer | H01J 49/165 | 250/424 |

(Continued)

*Primary Examiner* — David E Smith

(74) *Attorney, Agent, or Firm* — BainwoodHuang

(57) ABSTRACT

An ionization source for Electrospray Ionization (ESI) mass spectrometry includes a mass spectrometer having a source vacuum chamber having an inlet and an outlet. The outlet is disposed at an opening of the mass spectrometer. The ionization source further includes a hollow emission needle having an exit disposed at the inlet of the vacuum chamber. The hollow emission needle is configured to convey a first material toward the exit. An auxiliary line is disposed adjacent to the hollow emission needle to convey a second material toward the exit. A voltage supply apparatus is applied between the hollow emission needle and the mass spectrometer to establish a voltage between the hollow emission needle and the mass spectrometer and to induce particles to enter the mass spectrometer for analysis.

19 Claims, 3 Drawing Sheets

(56) References Cited

U.S. PATENT DOCUMENTS

| | | | | |
|---|---|---|---|---|
| 2005/0258360 | A1* | 11/2005 | Whitehouse | B01D 61/00 250/288 |
| 2010/0224695 | A1* | 9/2010 | Wu | B05B 5/001 239/3 |
| 2011/0042567 | A1* | 2/2011 | Yamaguchi | G01N 27/62 250/288 |
| 2013/0009055 | A1* | 1/2013 | Zhu | G01N 30/7266 250/288 |

* cited by examiner

IONIZATION SOURCE FOR ELECTROSPRAY IONIZATION MASS SPECTROMETRY AND MS ANALYSIS

CROSS-REFERENCES TO RELATED APPLICATIONS

This application claims the benefit of Chinese Patent Application No. 2015/107001283, filed Oct. 23, 2015, the contents and teachings of which are incorporated herein by reference in their entirety.

BACKGROUND

1. Field of the Invention

The present invention relates generally to analytical instruments, and more specifically to an ionization source for electrospray ionization mass spectrometry and its MS analysis.

2. Description of the Related Art

Electrospray Ionization (ESI) is an ionization technology used in mass spectrometry, which was first suggested by Dole et al. (M. Dole, L. L. Mack, R. L. Hines, R. C. Mobley, L. D. Ferguson, M. B. Alice, J. Chem. Phys. 49, 2240, 1968). Thereafter thousands of scientists around the world poured into this field since Nobel laureate John B. Fenn and his group first applied ESI to proteins and other biological macromolecular mass spectrometry in the late 80s, but the ionization mechanism still stays in two models: Ion Evaporation Model (IEM) and Charged Residue Model (CRM). The two theories describe the formation of gas-phase ions singly charged after the droplet left Taylor cone. Under ESI condition, there is a general explanation for the origin of multiply charged ions, which from the surface of the polar droplets may be formed in liquid phase in ESI.

SUMMARY

Unfortunately, the basic structure of the existing ESI source has no essential difference with that in the 1990s, and one of the biggest technological bottlenecks in the present proteomics is that the use of mass analyzer in biological mass spectrometry is very low.

In the existing ESI source, in addition to sending the charged molecular ions to a mass spectrometer, the ion transport system can also transfer a part of the neutral molecules to the vacuum chamber, which results in pollution and affecting the use of the mass spectrometer. However, there has been no good solution to this problem in the existing research and development of the ESI source.

In addition, according to the existing ESI source, the usual practice is to dissolve the analyte in the mobile phase and transfer close to the Taylor cone through the hollow emission needle. However, due to the dissolution of the solution in the mobile phase, the analyte molecule is dissolved in the droplet when the analyte leave the Taylor cone, and as the volume of the droplet is too large, the analyte molecule is difficult to be polarized, so the adsorption ability to hydrogen protons around the Taylor cone is weak and the molecular ionization efficiency is low.

In contrast with prior approaches, some embodiments are directed to an ionization source for Electrospray Ionization (ESI) mass spectrometry. The ionization source includes a mass spectrometer, the mass spectrometer having a source vacuum chamber, the source vacuum chamber having an inlet and an outlet, the outlet disposed at an opening of the mass spectrometer. The ionization source further includes a hollow emission needle having an exit, the exit disposed at the inlet of the vacuum chamber of the mass spectrometer, the hollow emission needle configured to convey a first material toward the exit of the hollow emission needle. An auxiliary line is disposed adjacent to the hollow emission needle and is configured to convey a second material toward the exit of the hollow emission needle. Further, a voltage supply apparatus is applied between the hollow emission needle and the mass spectrometer, to establish a voltage between the hollow emission needle and the mass spectrometer for inducing particles to enter the mass spectrometer for analysis.

Other embodiments are directed to a method for performing mass spectrometric analysis using an ionization source, such as the one described above.

The foregoing summary is presented for illustrative purposes to assist the reader in readily grasping example features presented herein; however, it is not intended to set forth required elements or to limit embodiments hereof in any way.

BRIEF DESCRIPTION OF THE SEVERAL VIEWS OF THE DRAWINGS

A further understanding of the present invention can be obtained by reference to a preferred embodiment set forth in the illustrations of the accompanying drawings, in which like numbers refer to like elements throughout. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention. For a more complete understanding of the present invention, reference is now made to the following drawings in which:

DETAILED DESCRIPTION OF THE INVENTION

Figure 1:
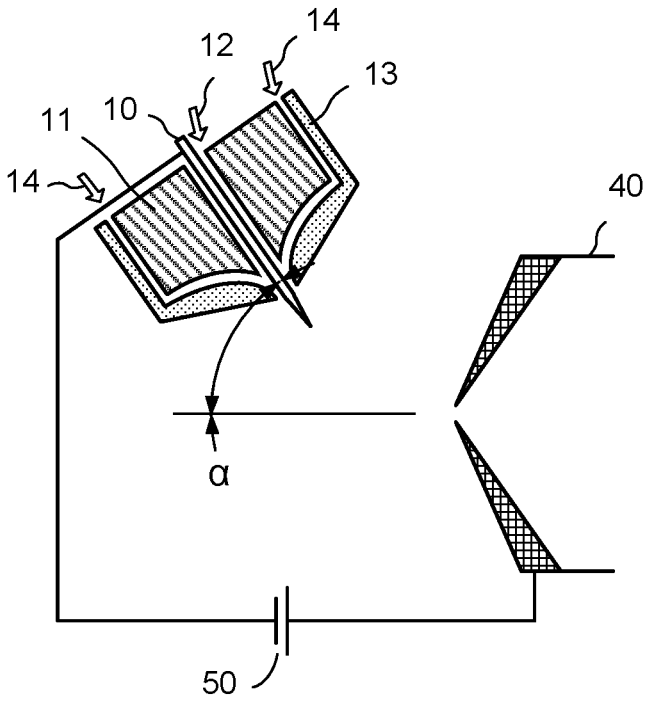
FIG. 1 is the structural schematic diagram of the electrospray ionization source of the first embodiment of the present invention.

Embodiments of the invention will now be described. It should be appreciated that such embodiments are provided by way of example to illustrate certain features and principles of the invention but that the invention hereof is not limited to the particular embodiments described.

Overview of Embodiments:

Based on the theory of multiply charged hydrogen (H+) formation by protonation from out of the Taylor cone in electro spray ionization, an objective of embodiments hereof is to make the structure of the ESI source further improved and propose a novel ionization source by effectively improving the charged probability of polarized molecules for electrospray ionization mass spectrometry. A rationale of embodiments hereof is that multiply charged hydrogen (H+) on the surface of the polar molecules is formed in gas phase from out of the Taylor cone, not formed in liquid phase, which has been approved by a lot of experiments. Embodiments of the present invention focus on a new structure of an ESI source based on the above theory and on a method for performing mass spectrometric analysis using the new ESI source.

In an example, embodiments of the present invention are realized by the application of the following technical scheme: An ESI source for mass spectrometry, which includes a mass spectrometer, a hollow emission needle, a first supply apparatus which is added between the hollow emission needle and the mass spectrometer, the vacuum chamber of the mass spectrometer whose entrance coincides with the exit (outlet) of the hollow emission needle, an emission needle-lock ring is sheathed on the outside of the hollow emission needle, and a first auxiliary line is arranged between the emission needle-lock ring and the emission needle.

In example use of the ESI source, one may lead incompletely insulating liquid without an analyte into the hollow emission needle, and import a medium for analysis into the first auxiliary line. The incomplete insulating liquid and the medium for analysis may be introduced, for example, using a micro flow injection pump to drive the solution flowing in the hollow emission needle or the first accessory line, or by regulating the pressure difference between the entrance and the exit of the hollow emission needle and the first accessory line so as to achieve the automatic induction of the medium. The hollow emission needle of the present invention can be a hollow glass capillary or a hollow metal capillary, for example.

Within the ESI source, the incomplete insulating liquid may be conducted through the hollow emission needle to an exit of said needle and, under the action of a voltage applied between the hollow emission needle and the mass spectrometer, forms a tip called a Taylor cone, which has a very small diameter, e.g., in the sub-micron range. At positive voltages, the water molecules around the Taylor cone bond to form a proton, H+. Meanwhile, the medium for analysis is introduced through the first auxiliary line to the Taylor cone, where the medium becomes polarized in the extremely high electric field of the Taylor cone tip. The polarized molecules adsorb a plurality of protons H+ and form (M+nH) n+ion clusters with a solvent. Kulun explosion occurs with continuous evaporation of the solvent, finally forming a stable ion cluster which is mainly composed of gasification samples, which enter into the mass spectrometer for mass spectrometry analysis.

Preferably, there is an angle alpha between the hollow emission needle and a horizontal direction of the inlet of the vacuum chamber of the mass spectrometer. The angle alpha is preferably greater than or equal to 0 DEG but less than 90 DEG.

Preferably, the mass spectrometer has a source vacuum chamber with an electrode device inside. The source vacuum chamber is equipped with an ESI source passageway. The outlet of the hollow emission needle extends into the ESI source passageway, which passes through the vacuum chamber of the mass spectrometer. The electrode device includes an inlet electrode, an outlet electrode, and a second voltage supply apparatus which is applied between the inlet electrode and the outlet electrode. Embodiments that employ the vacuum chamber having the electrode device can be effective in improving the ion productivity and the source transmission efficiency.

Preferably, the source vacuum chamber connects to at least one vacuum pump, and the setting of vacuum pump can effectively regulate the source vacuum chamber's environment.

As a better choice, the source vacuum chamber connects to at least one secondary accessary air source. Introducing the secondary accessary air source into the source vacuum chamber can effectively change the direction of the movement of the neutral non-charged molecules or atoms in the source vacuum chamber.

Preferably, there is a second-lock ring fitted on the outside of the emission needle-lock ring, and a second auxiliary line disposed between the second-lock ring and the emission needle-lock ring, which is convenient for introducing other common gas or high temperature auxiliary gas into the source vacuum chamber. When leading in common gas by the second auxiliary line, a liquid for analysis can be protected against evaporation in the outlet of the hollow emission needle so as to ensure the stability of the Taylor cone. When leading in high temperature auxiliary by the second auxiliary line, vaporization of multiply charged polar molecules can be accelerated.

Preferably, the second-lock ring and the outside of the source vacuum chamber are disposed in a source-housing, which is provided with an internal source electronic heater and/or an external source RF heater. The use of the source electronic heater or the source RF heater can further accelerate the formation of the gas phase molecule ion singly.

Preferably, there are 1-1000 intermediate electrodes disposed between the inlet electrode and the outlet electrode. The voltage of the second supply apparatus is positive and negative DC voltage or AC voltage or positive and negative pulse voltage or positive and negative DC voltage and AC voltage or a sum of positive and negative pulse voltage. The voltage of the first supply apparatus is positive and negative DC voltage or AC voltage or positive and negative pulse voltage.

Embodiments also includes application of any variant of the above ESI source for mass spectrometry analysis, including the following steps: S1, import an incompletely insulating liquid through the hollow emission needle, pass into liquid for analysis or gas for analysis or solid powder for analysis or any of a mixture of the first three and a temperature controlled gas through the first auxiliary line.

Or import incompletely insulating liquid into the hollow emission needle, connect the first auxiliary line with liquid phase chromatograph or gas chromatograph, or connect the mixture of the first two in either media for analysis and temperature controlled gas with the first auxiliary line.

At step S2, the voltage of the first supply apparatus is set to: positive and negative DC voltage 100V-100KV or positive and negative pulse voltage 100V-100KV, frequency 1-100 KHz or AC voltage 100V-100KV, frequency 1-100 KHz.

Further, the step S2 also includes setting a voltage of the second supply apparatus to: positive and negative DC voltage 0-10KV or positive and negative pulse voltage 0-10KV, frequency 1 Hz-1 MHz or AC voltage 0-10KV, frequency 1 Hz-1 MHz.

Preferably, the mass spectrometry analysis also includes a step S3 of regulating an outlet pressure of the ESI source passageway of the source vacuum chamber to less than or equal to an inlet pressure of the vacuum chamber of the mass spectrometer, and introducing at least one secondary accessary air source into the source vacuum chamber of the mass spectrometer. When the inlet pressure of the vacuum chamber of the mass spectrometer is adjusted to greater than or equal to outlet pressure of the ESI source passageway, the analysis further includes introducing a secondary accessary air source to the source vacuum chamber, which causes the neutral molecular clusters to run in a direction away from the mass spectrometer, so that the mass spectrometer is not easily contaminated.

Preferably, step S1 includes introducing temperature controllable gas or room temperature gas or a gas that can provide protons through the second auxiliary line. Among them, the proton gas can be the gas with water or organic acid vapor. The gas with water can be a mixture of water vapor, acid gas and water vapor, a mixture of organic acid vapor and water vapor, a mixture of nitrogen or argon gas or other gas and water vapor. The effect can be to provide more hydrogen ions around the Taylor cone, which can provide the hydrogen ions needed for the molecules to be ionized, thus increasing the charge probability of the samples for analysis.

Compared with existing technology, embodiment of the present invention have the following advantages and effects:

1. Provision of the first auxiliary line between the emission needle-lock ring and the hollow emission needle enables the medium for analysis to flow along the surface of the hollow emission needle to the outlet end of the hollow emission needle to realize the electrospray polarization of the medium in the Taylor cone field.

2. The second auxiliary line, as arranged in the instant ESI source, can facilitate the introduction of other room temperature gas or high temperature accessary gas to ensure the stability of the Taylor cone and accelerate the formation of the singly charge gas phase ion.

3. Introducing the secondary accessary air source into the source vacuum chamber may induces changes in direction of movement of neutral non-charged molecules or atoms in the source vacuum chamber, thus reducing or avoiding pollution of the mass spectrometer.

4. When performing mass spectrometric analysis, the incompletely insulating liquid flows through the hollow emission needle to the outlet end, and a high electric field is formed under the action of the high voltage between the mass spectrometer and the hollow emission needle. At the same time, the medium for analysis reaches the outlet end of the hollow emission needle along the first auxiliary line, where the medium is polarized in the extremely high electric field of the Taylor cone tip. The polarized molecules adsorb a plurality of protons H+, forming (M+nH) n+ charged particles. Compared with traditional methods of mass spectrometric analysis, which import the medium for analysis through the hollow emission needle itself, mass spectrometric analysis according to improvements hereof increase the utilization rate of the ESI source, especially in the mass spectrum detection of biological macromolecules such as proteins.

Description Of Particular Example Embodiments:

EXAMPLE 1

FIG. 1 shows an Ionization Source for Electrospray Ionization (ESI) Mass Spectrometry in accordance with embodiments of the invention. Here, the ionization source includes a mass spectrometer 40, hollow emission needle 10, and a first supply apparatus 50, which may apply a voltage between the hollow emission needle 10 and the mass spectrometer 40. The mass spectrometer 40 has a vacuum chamber whose entrance coincides with an exit of the hollow emission needle 10. An angle between the hollow emission needle 10 and the horizontal direction of the inlet of the vacuum chamber of the mass spectrometer 40 is alpha, which may be, for example, 0°, 20°, 30°, 45°, 50° or 60°. An emission needle-lock ring 11 is sheathed around the outside of the hollow emission needle 10, and a first auxiliary line 12 is arranged between the emission needle-lock ring 11 and the emission needle 10. The second-lock ring 13 is fitted on the outside of the emission needle-lock ring 11, and the second auxiliary line 14 is established between the second-lock ring 13 and the emission needle-lock ring 11.

In this first embodiment, the hollow emission needle 10 is a hollow glass capillary or the hollow metal capillary. In the first embodiment, the voltage of the first supply apparatus 50 is positive and negative DC voltage or AC voltage or positive and negative pulse voltage.

EXAMPLE 2

A method for mass spectrometric analysis using an electrospray ionization source described in the first embodiment includes the following steps:

At 51, introduce incompletely insulating liquid into the hollow emission needle 10, pass liquid for analysis or gas for analysis or solid powder for analysis or any of a mixture of the first three and a temperature controlled gas through the first auxiliary line 12, introduce into the temperature controllable gas or room temperature gas or the gas that can provide protons (H+) through the second auxiliary line 14. Among them, the proton gas can be a gas with water or organic acid vapor. The gas with water can be a mixture of water vapor, acid gas and water vapor, a mixture of organic acid vapor and water vapor, a mixture of nitrogen or argon gas or other gas and water vapor. The effect can be to provide more hydrogen ions around the Taylor cone, which can provide the hydrogen ions needed for the molecules to be ionized, thus increasing the charge probability of the samples for analysis.

At S2, set the voltage of first supply apparatus 50, which is positive and negative DC voltage 50KV or positive and negative pulse voltage 60KV, frequency 50 KHz or AC voltage 40KV, frequency 60 KHz.

Thereby, the incompletely insulating liquid is introduced through the hollow emitting needle 10 to the outlet end, and a Taylor cone is formed under the action of the positive and negative DC voltage or the positive and negative pulse voltage or the AC voltage between the mass spectrometer 40 and the hollow emission needle 10. Under such field, the liquid for analysis or the gas for analysis that reach the outlet end of the hollow emission needle 10 along the first auxiliary line 12 are polarized and, in the extremely high electric field of Taylor cone tip, adsorb a plurality of protons H+, forming charged particles.

EXAMPLE 3

Figure 2:
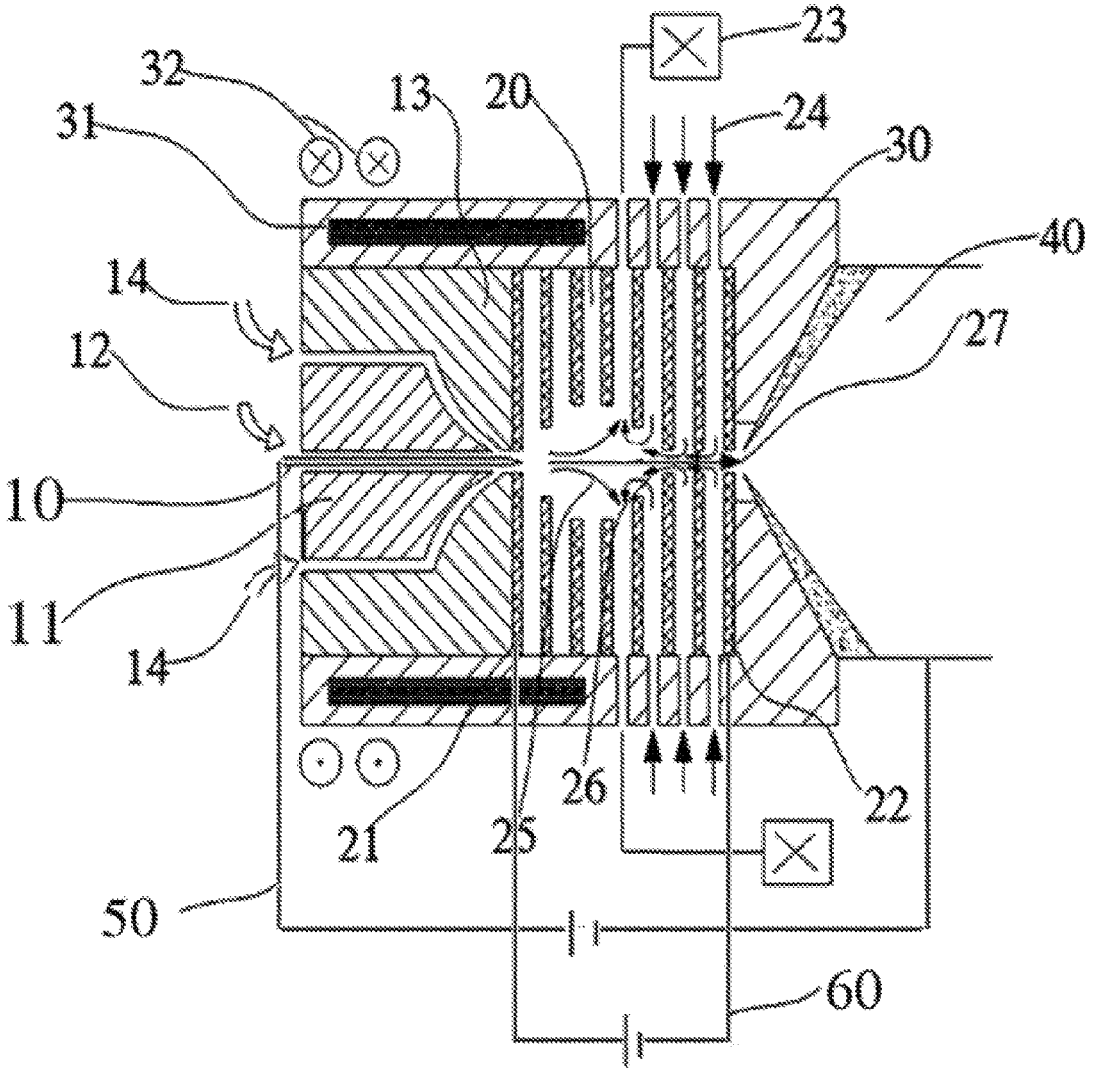
FIG. 2 is the structural schematic diagram of the electrospray ionization source of the third embodiment, the fourth embodiment, the sixth embodiment of the present invention.

FIG. 2 shows another novel Ionization Source for Electrospray Ionization Mass Spectrometry. A difference from the first embodiment is that, a source vacuum chamber 20 between the hollow emission needle 10 and the mass spectrometer 40 has an electrode device inside. The electrode device includes an inlet electrode 21 and an outlet electrode 22. Between the inlet electrode 21 and the outlet electrode 22 are a number of 1-50 or 50-100 or 100-300 or 300-500 or 500-800 or 800-1000 intermediate electrodes. A second voltage supply apparatus 60 is applied between the inlet electrode 21 and the outlet electrode 22. The electrode device is equipped with an ESI source passageway. The outlet of the hollow emission needle 10 extends into the ESI source passageway, which passes through the vacuum chamber of the mass spectrometer 40.

In the third embodiment, the voltage of the second supply apparatus 60 is the sum of positive and negative DC voltage or AC voltage or positive and negative pulse voltage or positive and negative DC voltage and AC voltage or positive and negative pulse voltage.

In the third embodiment, the medium for analysis and the incompletely insulating liquid cause electrospray ionization in the source vacuum chamber 20, and ion transport in the ESI source passageway, which are helpful to improve the ion productivity and the source transmission efficiency.

EXAMPLE 4

As shown in FIG. 2, a fourth embodiment can be seen, wherein a difference from the third embodiment is that the second-lock ring 13 and the outside of the source vacuum chamber 20 are provided within a source-housing 30. The source-housing 30 is provided with an interior source electronic heater 31 and/or an exterior source RF heater 32. The setting of the source electronic heater 31 and/or the source RF heater 32 can further accelerate the formation of the gas phase sample ion.

EXAMPLE 5

Another method for mass spectrometric analysis using an electrospray ionization source a described in the third embodiment or the fourth embodiment includes the following steps:

At S1, put incompletely insulating liquid into the hollow emission needle 10, connect the first auxiliary line 12 with a liquid chromatograph or a gas chromatograph, or after mixing the medium for analysis in the gas chromatograph or the liquid chromatograph and the temperature controlled gas, connect with the first auxiliary line 12, introduce into the temperature controlled gas or the gas can provide protons (H+) through the second auxiliary line 14.

At S2, set the voltage of first supply apparatus 50, which is positive and negative DC voltage 60KV or positive and negative pulse voltage 40KV, frequency 70 KHz or AC voltage 60KV, frequency 50 KHz. Set the voltage of second supply apparatus 60, which is positive and negative DC voltage 5KV or positive and negative pulse voltage 6KV, frequency 0.5 MHz or AC voltage 4KV, frequency 1 MHz.

EXAMPLE 6

As shown in FIG. 2, a sixth embodiment can be seen, wherein a difference from the third and fourth embodiments is that, the source vacuum chamber 20 connects to at least one vacuum pump 23, and the source vacuum chamber 20 connects to at least one secondary accessary air source 24.

The vacuum pump 23 of the sixth embodiment is used to regulate the source vacuum chamber's 20 environment, and at least one of the secondary accessary air source 24 is used to change the direction of the movement of the neutral molecules or atoms in the ESI source passageway.

EXAMPLE 7

Another method for mass spectrometric analysis involves using an electrospray ionization source as described in the sixth embodiment, which includes the following steps:

At S1, introduce incompletely insulating liquid into the hollow emission needle 10, pass liquid for analysis or gas for analysis or solid powder for analysis or any of a mixture of the first three and a temperature controlled gas through the first auxiliary line 12, and introduce the temperature controllable gas or room temperature gas or the gas that can provide protons (H+) through the second auxiliary line 14.

At S2, set the voltage of the first supply apparatus 50, which is positive and negative DC voltage 20KV or positive and negative pulse voltage 30KV, frequency 70 KHz or AC voltage 45KV, frequency 55 KHz. Set the voltage of the second supply apparatus 60, which is positive and negative DC voltage 3KV or positive and negative pulse voltage 6KV, frequency 0.5 MHz or AC voltage 4KV, frequency 0.6 MHz.

At S3, regulate the outlet pressure of the ESI source passageway of the source vacuum chamber 20 to less than or equal to the inlet pressure of the vacuum chamber of the mass spectrometer 40 through the vacuum chamber 23 and introduce at least one secondary accessary air source 24 into the source vacuum chamber 20 of the mass spectrometer 40.

As shown in FIG. 2, the charged molecular ion clusters 27 and forward-moving neutral molecular clusters 25 travel through the ESI source passageway. Under the least one secondary accessary air source 24, the charged molecular ion clusters 27 continue to move forward but the direction of movement of the forward-moving neutral molecular clusters 25 is reversed, thus forming backward-moving neutral molecular clusters 26, which move in a direction away from the mass spectrometer 40. This arrangement thus avoids introducing neutral molecular clusters into the vacuum chamber of the mass spectrometer 40 and thus avoids polluting the instrument.

EXAMPLE 8

Put water and 0.1% formic acid into the hollow emission needle 10, set the first supply apparatus 50 to DC voltage 1.2KV. Introduce into the sample for analysis (Ethylparaben, in this example) through the first auxiliary line 12 at a sample concentration of 10 ng/ul and at a velocity is 2 ul/min. Pump air into the second auxiliary line 14. The resulting signal obtained from the mass spectrometer 40 is shown in FIG. 3.

Put Ethylparaben at concentration of 10 ng/ul into the hollow emission needle 10 at a flow rate of 2 ul/min, set the first supply apparatus 50 to DC voltage 1.2KV, and pump air into the first auxiliary line 12 and the second auxiliary line 14. The resulting signal obtained from the mass spectrometer 40 is shown in FIG. 4.

Figure 3:
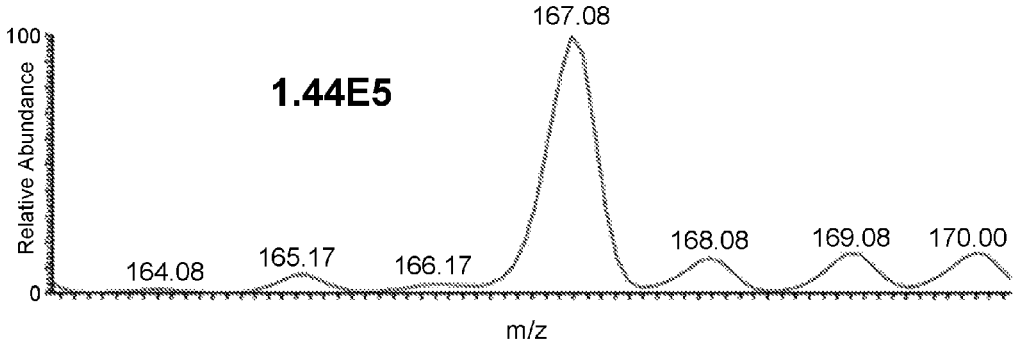
FIG. 3 is the signal spectrum of mass spectrometry analysis of Ethylparaben by the mass spectrometry analysis method of this present invention for the eighth embodiment.
Figure 4:
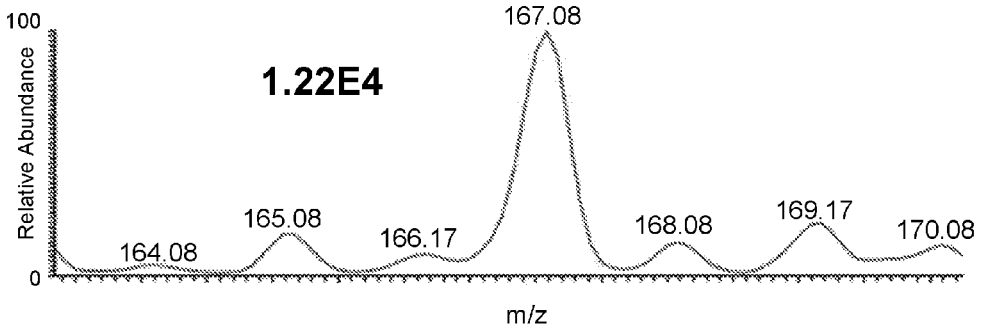
FIG. 4 is the signal spectrum of mass spectrometry analysis of Ethylparaben by the traditional mass spectrometry analysis method for the eighth embodiment.

The results as shown in FIGS. 3 and 4 reveal an improvement of one order of magnitude as compared with results from conventional ESI sources.

Having described certain embodiments, numerous alternative embodiments or variations can be made. Further, although features are shown and described with reference to particular embodiments hereof, such features may be included and hereby are included in any of the disclosed embodiments and their variants. Thus, it is understood that features disclosed in connection with any embodiment are included as variants of any other embodiment.

As used throughout this document, the words "comprising," "including," "containing," and "having" are intended to set forth certain items, steps, elements, or aspects of something in an open-ended fashion. Also, as used herein and unless a specific statement is made to the contrary, the word "set" means one or more of something. This is the case regardless of whether the phrase "set of" is followed by a singular or plural object and regardless of whether it is conjugated with a singular or plural verb. Further, although ordinal expressions, such as "first," "second," "third," and so on, may be used as adjectives herein, such ordinal expressions are used for identification purposes and, unless specifically indicated, are not intended to imply any ordering or sequence. Thus, for example, a second event may take place before or after a first event, or even if no first event ever occurs. In addition, an identification herein of a particular element, feature, or act as being a "first" such element, feature, or act should not be construed as requiring that there must also be a "second" or other such element, feature or act. Rather, the "first" item may be the only one. Although certain embodiments are disclosed herein, it is understood that these are provided by way of example only and that the invention is not limited to these particular embodiments.

Those skilled in the art will therefore understand that various changes in form and detail may be made to the embodiments disclosed herein without departing from the scope of the invention.

TABLE OF REFERENCE NUMERALS

Ref. Number Description
10 hollow emission needle
11 emission needle-lock ring
12 first auxiliary line
13 second-lock ring
14 second auxiliary line
20 source vacuum chamber
21 inlet electrode
22 outlet electrode
23 vacuum pump
24 secondary accessary air source
25 forward moving neutral molecular cluster
26 backward moving neutral molecular cluster
27 charged molecular ion cluster
30 source-housing
31 source electronic heater
32 source RF heater
40 mass spectrometer
50 first supply apparatus
60 second supply apparatus

What is claimed is:

1. An ionization source for Electrospray Ionization (ESI) mass spectrometry, the ionization source comprising:

a mass spectrometer, the mass spectrometer having a source vacuum chamber, the source vacuum chamber having an inlet and an outlet, the outlet disposed at an opening of the mass spectrometer;

a hollow emission needle having an exit, the exit disposed at the inlet of the vacuum chamber of the mass spectrometer, the hollow emission needle configured to convey a first material toward the exit of the hollow emission needle;

an auxiliary line disposed adjacent to the hollow emission needle, the auxiliary line configured to convey a second material toward the exit of the hollow emission needle; and a voltage supply apparatus applied between the hollow emission needle and the mass spectrometer, the voltage supply apparatus configured to establish a voltage between the hollow emission needle and the mass spectrometer for inducing particles to enter the mass spectrometer for analysis, wherein the first material is an incompletely insulating liquid and the second material is a medium to be analyzed.

2. The ionization source of claim 1, wherein the vacuum chamber has a horizontal axis, and wherein the hollow emission needle forms an angle of between zero and ninety degrees with the horizontal axis.

3. The ionization source of claim 2, wherein the source vacuum chamber includes an electrode device having an ESI source passageway that extends from the inlet of the source vacuum chamber to the outlet of the source vacuum chamber, the electrode device including an inlet electrode proximate to the inlet, an outlet electrode proximate to the outlet, and a second voltage supply apparatus applied between the inlet electrode and the outlet electrode.

4. The ionization source of claim 3, wherein the electrode device further includes between one and one thousand intermediate electrodes arranged between the inlet electrode and the outlet electrode.

5. The ionization source of claim 3, further comprising at least one vacuum pump connected to the source vacuum chamber to regulate pressure in the source vacuum chamber.

6. The ionization source of claim 5, further comprising a secondary air source connected to the source vacuum chamber, the secondary air source configured to introduce air into the source vacuum chamber.

7. The ionization source of claim 2, further comprising an emission needle-lock ring disposed around an outside of the hollow emission needle, wherein the auxiliary line is disposed in a space between the hollow emission needle and the emission needle-lock ring.

8. The ionization source of claim 7, further comprising a second auxiliary line configured to convey additional material toward the exit of the hollow emission needle.

9. The ionization source of claim 8, further comprising a second-lock ring disposed around an outside of the emission needle-lock ring, wherein the second auxiliary line is disposed in a space between the emission needle-lock ring and the second emission needle-lock ring.

10. The ionization source of claim 9, wherein the second-lock ring and the source vacuum chamber are disposed within a source-housing, the source housing having a heater.

11. The ionization source of claim 10, wherein the heater is provided in the form of (i) an electronic heater within the source-housing and/or (ii) an RF (Radio Frequency) heater disposed outside the source-housing.

12. An ionization source for Electrospray Ionization (ESI) mass spectrometry, the ionization source comprising:

a mass spectrometer, the mass spectrometer having a source vacuum chamber, the source vacuum chamber having an inlet, an outlet, and a source passageway extending in a first direction between the inlet and the outlet, the outlet disposed at an opening of the mass spectrometer;

a hollow emission needle having an exit, the exit disposed at the inlet of the vacuum chamber of the mass spectrometer, the hollow emission needle configured to convey a first material toward the exit of the hollow emission needle;

an auxiliary line disposed in parallel with the hollow emission needle, the auxiliary line configured to convey a second material toward the exit of the hollow emission needle; and a voltage supply apparatus electrically connected to the hollow emission needle and to the mass spectrometer, the voltage supply apparatus configured to establish a voltage between the hollow emission needle and the mass spectrometer for inducing particles to move through the source passageway in the first direction and toward the opening of the mass spectrometer, wherein the source vacuum chamber includes an airflow path extending in a second direction different from the first direction and intersecting the source passageway, the airflow path configured to conduct gas from a secondary air source into the source passageway, wherein the first material is an incompletely insulating liquid and the second material is a medium to be analyzed.

13. The ionization source of claim 12, wherein the vacuum chamber has a horizontal axis, and wherein the hollow emission needle forms an angle greater than zero degrees and less than ninety degrees with the horizontal axis.

14. A method for mass spectrometric analysis, the method performed using an apparatus that includes:

a mass spectrometer, the mass spectrometer having a source vacuum chamber, the source vacuum chamber having an inlet and an outlet, the outlet disposed at an opening of the mass spectrometer;

a hollow emission needle having an exit, the exit disposed at the inlet of the vacuum chamber of the mass spectrometer, the hollow emission needle configured to convey a first material toward the exit of the hollow emission needle;

an auxiliary line disposed adjacent to the hollow emission needle, the auxiliary line configured to convey a second material toward the exit of the hollow emission needle; and a voltage supply apparatus applied between the hollow emission needle and the mass spectrometer, the voltage supply apparatus configured to establish a voltage between the hollow emission needle and the mass spectrometer for inducing charged ion clusters to enter the mass spectrometer for analysis, wherein the method comprises:

introducing an incompletely insulating liquid into the hollow emission needle;

introducing a material to be analyzed into the auxiliary line; and directing the mass spectrometer to perform an analysis.

15. The method of claim 14, further comprising connecting the auxiliary line to at least one of a liquid phase chromatograph and a gas chromatograph.

16. The method of claim 14, further comprising directing voltage supply apparatus to apply a varying voltage between 100 V and 100KV at a frequency between 1 KHz and 100 KHz.

17. The method of claim 14, wherein the source vacuum chamber includes an electrode device having an ESI source passageway that extends from the inlet of the source vacuum chamber to an outlet of the source vacuum chamber, the electrode device including an inlet electrode proximate to the inlet, an outlet electrode proximate to the outlet, and a second voltage supply apparatus applied between the inlet electrode and the outlet electrode, and wherein the method further comprises directing the second voltage supply apparatus to apply a varying voltage between 0 and 10KV at a frequency between 1 Hz and 1 MHz.

18. The method of claim 14, further comprising:

regulating an outlet pressure of the source passageway of the source vacuum chamber to less than or equal to an inlet pressure of the vacuum chamber of the mass spectrometer; and introducing air from at least one secondary accessary air source into the source vacuum chamber of the mass spectrometer 40.

19. The method of claim 18, wherein the apparatus further includes a second auxiliary line configured to convey additional material toward the exit of the hollow emission needle, and wherein the method further comprises introducing a gas that can provide protons through the second auxiliary line.

* * * * *